United States Patent [19]

Hara et al.

[11] 4,300,491

[45] Nov. 17, 1981

[54] CONTROL APPARATUS FOR GLOW PLUGS PROVIDED FOR A DIESEL ENGINE

[75] Inventors: Toshizo Hara, Kawajima; Tsutomu Yamada, Nagatoro, both of Japan

[73] Assignee: Diesel Kiki Co., Ltd., Tokyo, Japan

[21] Appl. No.: 53,422

[22] Filed: Jun. 29, 1979

[30] Foreign Application Priority Data

Jun. 30, 1978 [JP] Japan ..... 53-89347[U]

[51] Int. Cl.[3] ..... F02P 19/02

[52] U.S. Cl. ..... 123/179 BG; 123/179 H

[58] Field of Search ..... 123/179 BG, 179 B, 179 H, 123/145 A

[56] References Cited

U.S. PATENT DOCUMENTS 4,088,109 5/1978 Woodruff et al. ..... 123/179 BG
4,137,885 2/1979 Van Ostrom ..... 123/179 H

FOREIGN PATENT DOCUMENTS 2360841 6/1975 Fed. Rep. of Germany ... 123/145 A
2549703 5/1977 Fed. Rep. of Germany ... 123/145 A
2300229 10/1976 France ..... 123/179 H

*Primary Examiner*—Charles J. Myhre
*Assistant Examiner*—Andrew M. Dolinar
*Attorney, Agent, or Firm*—Birch, Stewart, Kolasch & Birch

[57] ABSTRACT

A control apparatus for glow plugs provided for a diesel engine is disclosed, in which the time for preheating of glow plugs prior to starting of the engine, that is, the time for applying an electric current to the glow plugs from a battery, is controlled according to such factors as engine temperature and battery voltage. When the engine is cold, control is carried out so that as the engine temperature is lower or the battery voltage is lower, the preheating time is more prolonged. Accordingly, an optimum preheating time is ensured. When the engine is warmed up, control is carried out so that even is a key switch is set at a preheating position, preheating is not effected whatsoever.

1 Claim, 6 Drawing Figures

CONTROL APPARATUS FOR GLOW PLUGS PROVIDED FOR A DIESEL ENGINE

BACKGROUND OF THE INVENTION (1) Field of the Invention

The present invention relates to a control apparatus for a glow plug-type preheating device provided for a diesel engine for vehicles, and in particular, relates to an apparatus for controlling the preheating time of a diesel engine by a glow plug-type preheating device.

(2) Description of the Prior Art

In a conventional glow plug-type preheating device for a diesel engine, the time for preheating by glow plugs, that is, the time for applying an electric current to glow plugs, is adjusted by a driver based on the red heat state of an indicator including an electric heating wire. In this case, however, influences of the ambient temperature or the warming-up state of the engine can hardly be judged by an inexperienced driver and therefore, control of the preheating time is difficult for ordinary drivers.

As means for overcoming this disadvantage, there has been proposed a method in which the time of preheating by glow plugs is controlled depending on the engine temperature or battery voltage. In a control apparatus where the preheating time is controlled according to the engine temperature, for example, the temperature of engine cooling water is detected by a thermistor or the like and the preheating time is set by a timer which is arranged so that the set time is changed according to a detection voltage from the thermistor or the like.

However, since the change of the electric resistance according to the change of the temperature is not so great in the thermistor, the relation between the temperature of engine cooling water and the preheating time is as indicated by characteristic curve "a" of FIG. 1, and when the engine is warmed up, the preheating time is unnecessarily prolonged. As means for eliminating this defect, there has been adopted a method in which the detection voltage of the termistor is applied to the timer through an amplifier to obtain a characteristic as indicated by curve "b" of FIG. 1 or a method in which a comparator is additionally disposed to cut the characteristic "a" at the point "c" in FIG. 1. If such method is adopted, however, an amplifier or comparator has to be additionally disposed, and the cost of the control apparatus is inevitably increased.

SUMMARY OF THE INVENTION

It is therefore a primary object of the present invention to provide a control apparatus in which, by a simple circuit structure, the preheating time is appropriately controlled depending on the battery voltage and when the engine temperature is higher than a predetermined level, the preheating time is reduced to zero.

In order to attain this object, in the present invention, the preheating time is determined according to comparison between a voltage generated by a thermistor sensitive to the engine temperature based on the voltage of a constant-voltage circuit and the sum of a voltage of charging based on a power supply voltage or the terminal voltage of glow plugs and a predetermined constant voltage, and when the engine temperature is higher than a predetermined level, the preheating time is reduced to zero and when the engine temperature is lower than the predetermined level, the preheating time is controlled depending on the engine temperature and the power supply voltage or the terminal voltage of the glow plugs.

DETAILED DESCRIPTION OF THE PREFERRED EMBODIMENT

Figure 2:
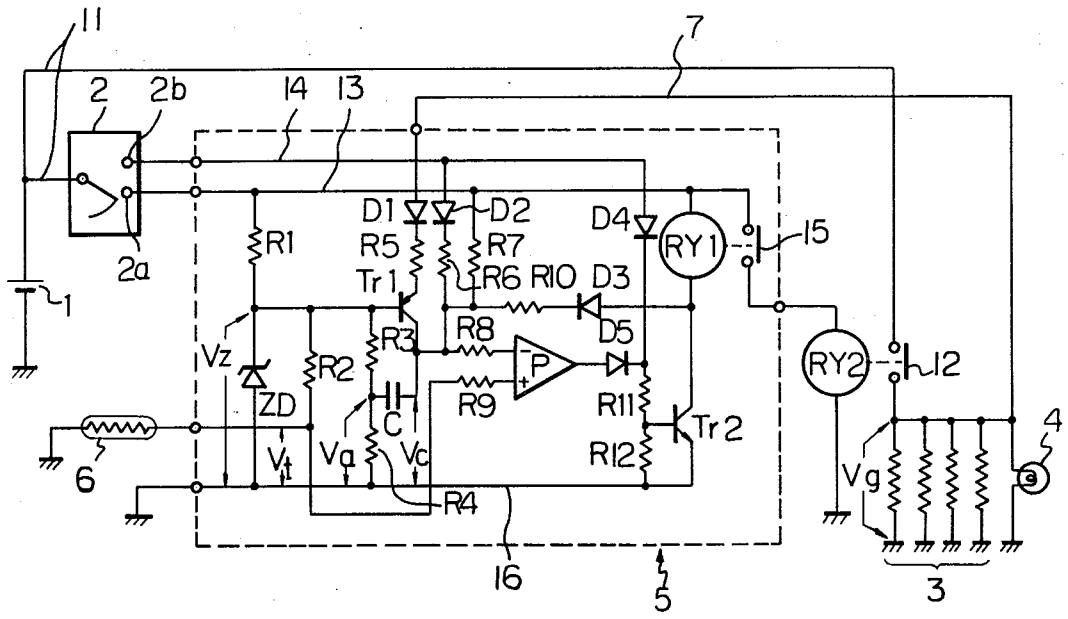
FIG. 2 is a circuit diagram illustrating one embodiment of the control apparatus according to the present invention.

Referring to FIG. 2, a line 11 connected to a positive terminal of a battery 1 is connected to a key switch 2 and is also connected through a normally open relay switch 12 to one of the terminals of glow plugs 3 disposed in respective combustion chambers and a pilot lamp 4. The other terminal of the glow plugs 3 and pilot lamp 4 are grounded.

The key switch 2 can be changed to any of the following positions, respectively, that is, an OFF position, an ON position (preheating contact 2*a*) and a START position (preheating contact 2*a* and starter contact 2*b*), and the preheating contact 2*a* and starter contact 2*b* are respectively connected to lines 13 and 14 in a preheating time control circuit 5.

One of the terminals of resistor R1, resistor R7, normally opens relay switch 15 and relay coil RY1 of the relay switch 15, respectively is connected in parallel to the line 13 connected to the preheating contact 2*a*. The other terminal of the relay switch 15 is connected to one of the terminals of a relay coil RY2 of the above-mentioned relay switch 12, and the other terminal of the relay coil RY2 is grounded.

One of the terminals of a zener diode ZD as a constant-voltage regulated power supply (constant voltage Vz) is connected to the other terminal of the resistor R1, and the other terminal of the zener diode ZD is connected to a grounding line 16. One of the terminals of resistors R2 and R3 and the base terminal of a transistor Tr1 are connected to the connection point of the resistor R1 and zener diode ZD. The other terminal of the resistor R2 is connected to one of the terminals of a thermistor 6 for detecting the temperature of engine cooling water, the other terminal of the thermistor 6 being grounded. One of the terminals of a resistor R4 is connected to the other terminal of the resistor R4, the other terminal of the resistor R4 being connected to the grounding line 16.

The emitter terminal of the transistor Tr1 is connected through a resistor R5 and a diode D1 to a line 7 connected to the above-mentioned one terminal of the glow plugs 3 for input of a terminal voltage Vg of the glow plugs 3. One of the terminals of a condenser C and a resistor R8 are connected to the collector terminal of the transistor Tr1 and the other terminal of the condenser C is connected to the connection point of the resistors R3 and R4 and the other terminal of the resistor R8 is connected to a negative input terminal of a comparator P. The connection point of the resistor R2 and the thermistor 6 is connected through a resistor R9 to a positive input terminal of the comparator P.

A diode D5, a resistor R11 and a resistor R12 are interposed in series between the output terminal of the comparator P and the grounding line 16, and the connection point of the resistors R11 and R12 is connected to the base terminal of a transistor Tr2.

To the other terminal of the above-mentioned relay coil RY1 are connected the collector terminal of the transistor Tr2 and one of the terminals of a diode D3, and the emitter terminal of the transistor Tr2 is connected to the grounding line 16. The other terminal of the diode D3 is connected through a resistor R10 to the connection point of the collector terminal of the transistor Tr1 and the condenser C (and the resistor R8). Also, the other terminal of the resistor R7 is connected to the connection point of the collector terminal of the transistor Tr1 and the condenser C.

One of the terminals of diodes D2 and D4 is respectively connected in parallel to the line 14 connected to the starter contact 2*b*. The other terminal of the diode D2 is connected through the resistor R6 to the connection point of the collector terminal of the transistor Tr1 and the condenser C and the other terminal of the diode D4 is connected to the connection point of the diode D5 and the resistor R11.

The operation of the control apparatus of the present invention illustrated in FIG. 2 will now be described by reference to FIGS. 3 through 5.

When the engine temperature is low, for example, in case of T (temperature of engine cooling water)=-T1<Ta and Vt (terminal voltage of thermistor 6)=Vt1>Va (Va is a voltage obtained by dividing the zener voltage Vz of the zener diode ZD by the resistors R3 and R4, and if the impedance is adjusted to a low level, Va can be regarded as a constant voltage), if the preheating contact 2*a* is closed by the key switch 2 in order to start the engine, since the relation of Vc=Va (Vc stands for the sum of the constant voltage Va and the charged voltage of the condenser C) is established at the moment when the preheating contact 2*a* is closed, the relation of Vt1>Vc is established and the output of the comparator P comparing these voltages is at a high level. While the output of the comparator P is at a high level, the transistor Tr2 becomes ON to excite the relay coil RY1 to close the relay switch 15, and furthermore, the relay coil RY2 is excited to close the relay switch 12. Accordingly, the glow plugs 3 are actuated and the pilot lamp 4 is lighted to inform a driver that the preheating is being carried out.

In this state, the condenser C is charged with the sum (i5+i7) of an electric current (i7) flowing through the resistor R7 and an electric current (i5) flowing through the diode D1, resistor R5 and transistor Tr1 according to the terminal voltage Vg of the glow plugs 3, and the voltage Vc is increased with lapse of time.

When the relation of Vc>Vt1 is established by increase of the voltage Vc, the output of the comparator P is reversed to a low level. Accordingly, the transistor Tr2 becomes OFF to de-energize the relay coil RY1 to open the relay switch 15, and furthermore, the relay coil RY2 is de-energized to open the relay switch 12. Actuation of the glow plugs 3 is stopped and the pilot lamp 4 is shut off to inform the driver that preheating has been completed.

In this state, though the current (i5) is zero, a large current (i10) is caused to flow through the diode D3 and resistor R10 according to the voltage on the collector side of the transistor Tr2 at the moment when the transistor Tr2 becomes OFF and the condenser C is charged with this current (i10), whereby the voltage Vc is maintained at a high level and re-preheating is prevented.

Figure 1:
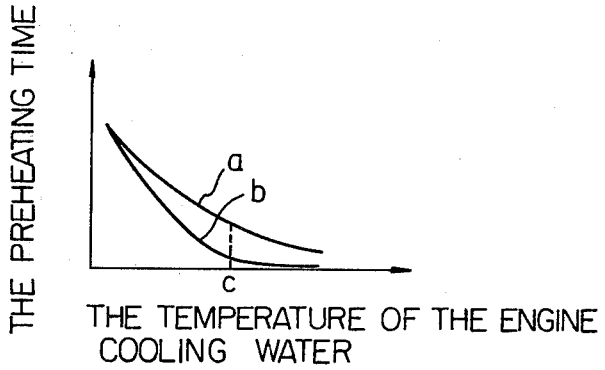
Fig. 1 (PRIOR ART)
FIG. 1 is a diagram illustrating the relation between the temperature of engine cooling water and the preheating time in the conventional apparatus.
Figure 3:
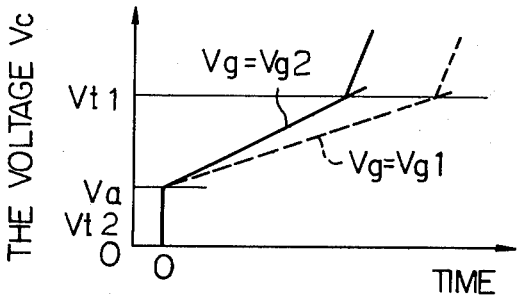
FIG. 3 is a diagram illustrating the change of the voltage Vc with lapse of time in the embodiment shown in FIG. 2.

The change of the voltage Vc with lapse of time is illustrated in FIG. 3. In FIG. 3, the solid line indicates the change observed in case of Vg=Vg2 and the broken line indicates the change observed in case of Vg=Vg1, wherein Vg2 is higher than Vg1. The charging current (i5) to the condenser C depends on the terminal voltage Vg of the glow plugs 3 and therefore, as the terminal voltage Vg is higher, charging of the condenser C can be accomplished more promptly. Accordingly, when comparison is made at the same cooling water temperature, the higher the terminal voltage Vg, the shorter the preheating time as seen from FIG. 3.

In the foregoing embodiment, the preheating time is controlled based on the terminal voltage Vg of the glow plugs 3. In the present invention, there may be adopted a modification in which the preheating time is controlled based on the power supply voltage (the voltage of the preheating contact 2*a*).

Completion of preheating is confirmed by extinction of the pilot lamp 4 and then the starter contact 2*b* is closed by the key switch 2 to drive a starter motor (not shown) and start the engine. When the starter contact 2*b* is closed, the transistor Tr2 is put on through the diode D4, whereby the glow plugs 3 are actuated again to facilitate start of the engine.

The functions of the diode D2 and resistor R6 will now be described.

Figure 5:
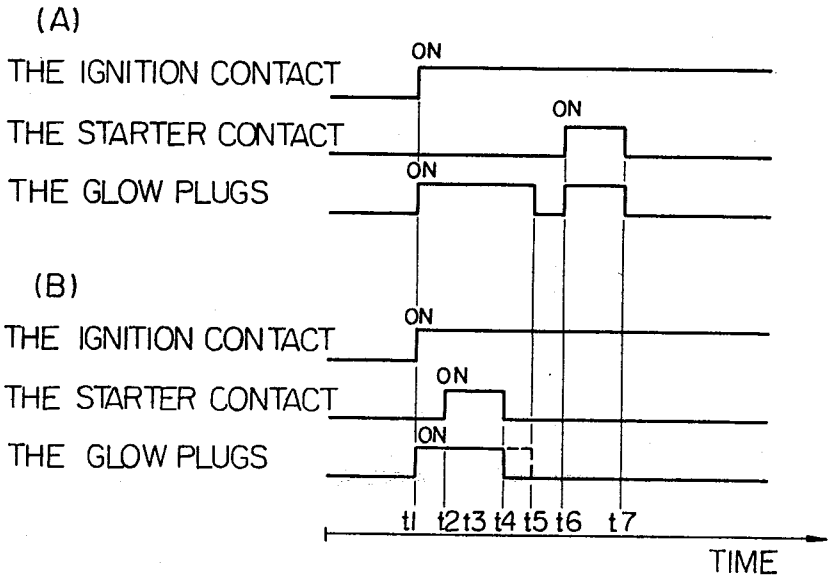
FIGS. 5-(A) and 5-(B) are timing charts illustrating the safety at the time of an erroneous operation in the embodiment shown in FIG. 2.

When the driver carries out the operation correctly, the preheating is performed by the glow plugs 3 as shown in FIG. 5-(A). If the starter contact 2*b* is closed to start the engine at the point t2 even during the preheating as shown in FIG. 5-(B), the glow plugs 3 are shut off at the point t4 because of starting of the engine and the preheating is conducted during the period of from the point t4 to the point t5 even after the engine has been started. In the embodiment illustrated in FIG. 2, occurrence of this disadvantage is prevented in the following manner.

When the starter contact 2*b* is closed, the condenser C is promptly charged through the diode D2 and the resistor R6 (the electric resistance of this resistor R6 is much less than that of the resistor R7) and the output of the comparator P is reversed at the point t3. If the starter contact 2*b* is closed, even when the output of the comparator P is reversed to a low level, the transistor Tr2 is kept actuated through the diode D4 and hence, also the glow plugs 3 are kept actuated. However, when the starter contact 2*b* is opened at the point t4, since the output of the comparator P has already been reversed to a low level, no electric current is applied to the glow plugs 3 any longer after the point t4. Accordingly, the above-mentioned disadvantage is eliminated.

When the engine temperature is high, for example, in case of T (cooling water temperature)=T2>Ta and Vt (terminal voltage of thermistor 6)=Vt2<Va, even if the preheating contact 2*a* is closed by the key switch 2, since the relation of Vt2<Vc is already established at this moment, the output of the comparator P is kept at a low level. Accordingly, the transistor Tr2 is shut off and the relay coils RY1 and RY2 are not excited. As a result, the preheating by the glow plugs 3 is not conducted. When the starter contact 2b is closed by the key switch 2, the preheating is carried out for the first time.

Figure 4:
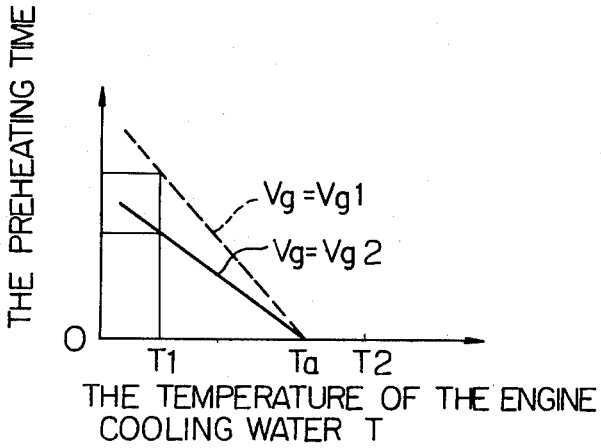
FIG. 4 is a diagram illustrating the relation between the temperature of engine cooling water and the preheating time in the embodiment shown in FIG. 2.

As will be apparent from the foregoing illustration, in the present invention, since one terminal of the condenser C is connected to the constant-voltage regulated power supply, the time of preheating before starting of the engine can be reduced to zero as shown in FIG. 4 if the cooling water temperature T is higher than the predetermined level Ta. The constant voltage Va is one obtained by dividing the zener voltage Vz of the zener diode ZD by the resistors R3 and R4. Ideally, it is preferred to use a zener diode instead of the resistor R4.

In the foregoing embodiment, the cooling water temperature is detected by the thermistor. In the present invention, the temperature of intaken air or the atmosphere or oil temperature may be detected instead of the cooling water temperature. Furthermore, the comparator P is not limited to IC but it may be constructed by a transistor circuit.

As illustrated hereinbefore, according to the present invention, since the time of the preheating is determined by comparison between the voltage generated by the thermistor sensitive to the engine temperature based on the voltage of the constant-voltage circuit and the sum of the voltage of charging based on the power supply voltage or the terminal voltage of glow plugs and the predetermined constant voltage, when the engine temperature is higher than a predetermined level, the preheating time is reduced to zero and when the engine temperature is lower than the predetermined level, the preheating time is appropriately controlled according to the engine temperature based on the power supply voltage or the terminal voltage of the glow plugs. Furthermore, such means as an amplifier or comparator need not be additionally disposed as pointed out hereinbefore, and the circuit structure can be remarkably simplified.

What is claimed is:

1. Control apparatus for glow plugs of a preheating device provided for preheating a diesel engine comprising:

a power supply;

a first relay having an ON-OFF relay switch for applying a voltage from said power supply to the glow plugs;

a key switch connected to said power supply and having an OFF position, an ON position in which a preheating contact is closed for preheating, and a START position in which the preheating contact and a starter contact are both closed for starting the diesel engine;

a second relay connected to said preheating contact and having an ON-OFF relay switch connected to the first relay;

a thermistor for generating a temperature voltage which corresponds to a temperature of diesel engine cooling water;

a first resistor and a zener diode connected to said preheating contact;

a first transistor receiving a zener voltage of the zener diode to a base terminal thereof;

a second and a third resistor for dividing said zener voltage;

a condenser connected between a collector terminal of the first transistor and a connection point of the second and the third resistors;

a comparator having two input terminals, a first one of said terminals being connected to said thermistor and a second one of said terminals being connected to said condenser, said preheating contact being connected to said second one of said terminals through a fourth resistor, said starter contact being connected to said second one of said terminals through a first diode and fifth resistor, respectively;

a second diode connected between said starter contact and an output of said comparator;

a sixth and a seventh resistor connected to the output of said comparator;

a second transistor for exciting said second relay by inputting a dividing voltage of the sixth and the seventh resistors;

a third diode and an eighth resistor connected between an emitter terminal of the first transistor and the glow plugs;

a fourth diode and a ninth resistor connected between the collector terminal of the first transistor and a collector terminal of the second transistor; and a pilot lamp connected in parallel to the glow plugs;

wherein the first relay is ON-OFF controlled by the ON-OFF relay switch of the second relay, and the ON-OFF relay switch of the first relay ON-OFF controls to apply voltage of the power supply to the glow plugs, thereby to control a preheating time of the glow plugs depending on the temperature of said diesel engine cooling water and a terminal voltage of the glow plugs when said key switch is operated at the ON position or the START position.

* * * * *